US005119943A

United States Patent [19]

Hoang

[11] Patent Number: 5,119,943

[45] Date of Patent: Jun. 9, 1992

[54] DISH DRAINAGE APPARATUS

[76] Inventor: Alex L. Hoang, 11096 Stonecress Ave., Fountain Valley, Calif. 90708

[21] Appl. No.: 756,519

[22] Filed: Sep. 9, 1991

[51] Int. Cl.[5] ..... A47F 7/00

[52] U.S. Cl. ..... 211/41; 211/168

[58] Field of Search ..... 211/41, 168, 62, 49.1, 211/70.7; 219/366

[56] References Cited

U.S. PATENT DOCUMENTS

| | | | |
|---|---|---|---|
| 508,885 | 11/1893 | Johnston | 211/41 X |
| 1,406,773 | 2/1922 | Stoffel | 211/41 |
| 3,007,256 | 11/1961 | Rouy | 211/41 X |
| 4,756,582 | 7/1988 | Heinn | 211/41 X |
| 4,812,621 | 3/1989 | Brotherton et al. | 211/41 X |

*Primary Examiner*—Alvin C. Chin-Shue

*Assistant Examiner*—Sarah A. Lechok

*Attorney, Agent, or Firm*—Leon Gilden

[57] ABSTRACT

An upper rectilinear framework includes a matrix of drainage rails directed orthogonally between side walls of the framework, with the framework mounting a lowered apertured drainage tray thereto. The framework is pivotally mounted to an underlying support base, wherein the underlying support base includes a floor angulated downwardly relative to a rear wall and side wall structure of the support base. A modification of the invention includes a drying manifold to direct air interiorly of the framework and further includes an accessory fluid receiving trough and reservoir within the framework, with the reservoir containing a germicidal and/or fungicidal fluid contained therewithin.

1 Claim, 5 Drawing Sheets

DISH DRAINAGE APPARATUS

BACKGROUND OF THE INVENTION

1. Field of the Invention

The field of invention relates to dish drainage apparatus, and more particularly pertains to a new and improved dish drainage apparatus wherein the same is arranged to provide a fluid-directing trough member to direct fluid drained from associated dishes contained within the apparatus.

2. Description of the Prior Art

Dish drying structure of the prior art has been utilized with water typically drained from such apparatus directed to an orientation below the support framework, as typified in U.S. Pat. No. 463,056 to Jayne and U.S. Pat. No. 1,889,146 to Kalenoff.

Such structure in the prior art has failed to provide orientation and direction for draining fluid into an associated sink structure typically utilized in association with such dish drying apparatus.

Accordingly, it may be appreciated that there continues to be a need for a new and improved dish draining apparatus as set forth by the instant invention which addresses both the problems of ease of use as well as effectiveness in construction in directing drainage fluid from the apparatus and in this respect, the present invention substantially fulfills this need.

SUMMARY OF THE INVENTION

In view of the foregoing disadvantages inherent in the known types of dish drying apparatus now present in the prior art, the present invention provides a dish drainage apparatus wherein the same is arranged for orienting and directing draining fluid from associated dishes contained within the apparatus. As such, the general purpose of the present invention, which will be described subsequently in greater detail, is to provide a new and improved dish drainage apparatus which has all the advantages of the prior art dish drying apparatus and none of the disadvantages.

To attain this, the present invention provides an upper rectilinear framework including a matrix of drainage rails directed orthogonally between side walls of the framework, with the framework mounting a lowered apertured drainage tray thereto. The framework is pivotally mounted to an underlying support base, wherein the underlying support base includes a floor angulated downwardly relative to a rear wall and side wall structure of the support base. A modification of the invention includes a drying manifold to direct air interiorly of the framework and further includes an accessory fluid receiving trough and reservoir within the framework, with the reservoir containing a germicidal and/or fungicidal fluid contained therewithin.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved dish drainage apparatus which has all the advantages of the prior art dish drying apparatus and none of the disadvantages.

It is another object of the present invention to provide a new and improved dish drainage apparatus which may be easily and efficiently manufactured and marketed.

It is a further object of the present invention to provide a new and improved dish drainage apparatus which is of a durable and reliable construction.

An even further object of the present invention is to provide a new and improved dish drainage apparatus which is susceptible of a low cost of manufacture with regard to both materials and labor, and which accordingly is then susceptible of low prices of sale to the consuming public, thereby making such dish drainage apparatus economically available to the buying public.

Still yet another object of the present invention is to provide a new and improved dish drainage apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
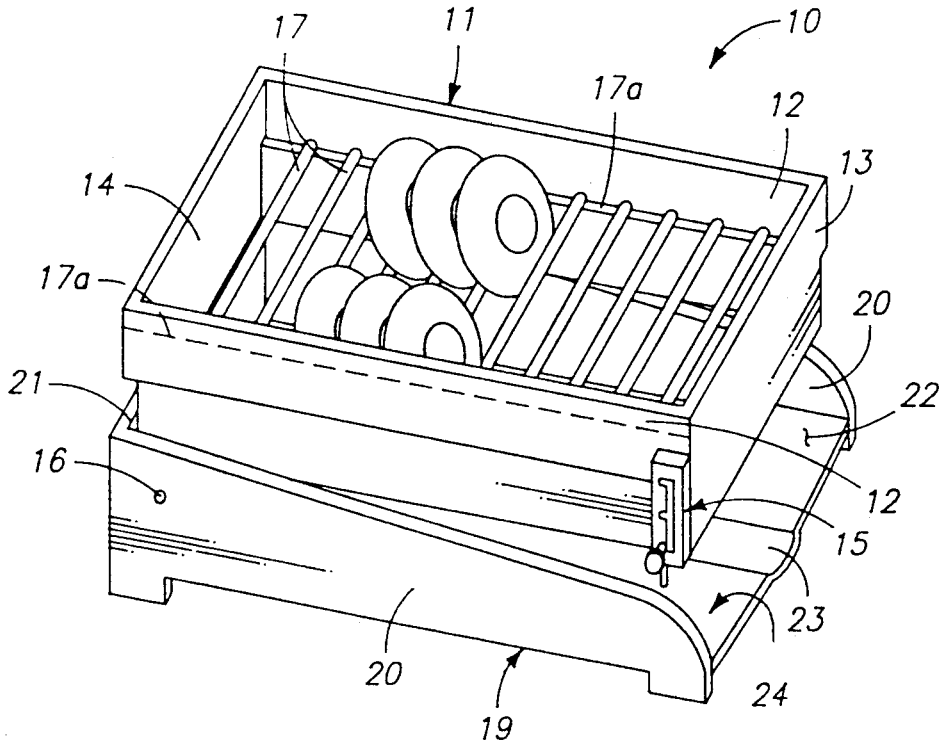
FIG. 1 is an isometric illustration of the instant invention.
Figure 2:
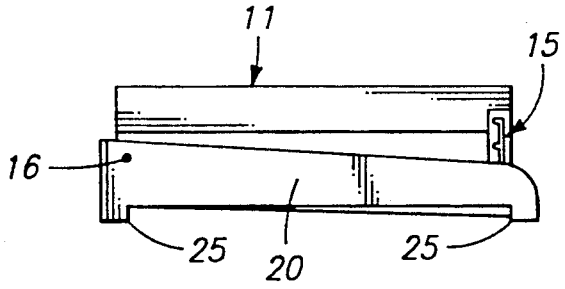
FIG. 2 is an orthographic side view of the instant invention.
Figure 3:
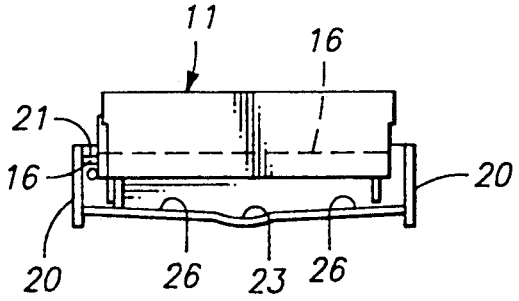
FIG. 3 is an orthographic end view of the instant invention.

With reference now to the drawings, and in particular to FIGS. 1 to 13 thereof, a new and improved dish drainage apparatus embodying the principles and concepts of the present invention and generally designated by the reference numerals 10 and 10*a* will be described.

More specifically, the dish drainage apparatus of the invention essentially comprises an upper rectilinear framework defined by framework side walls 12 arranged in a parallel relationship, wherein the framework 11 further includes a front wall 13 spaced from and parallel a rear wall 14, wherein the front and rear walls are orthogonally oriented relative to the side walls 12. An adjustment member 15 is mounted at an intersection of a side wall 12 and the front wall 13 to effect selective pivotment of the upper rectilinear framework 11 to a support base 19 about a pivot axle 16 directed through a support base 19 adjacent to and parallel a support base rear wall 21 and orthogonally through the support base side walls 20 adjacent the rear wall 21, with the pivot axle 16 directed through the framework side walls 12 adjacent the rear wall 14. A support rod ledge 17*a* is arranged coextensively within an interior surface of each side wall 12 to define a plurality of spaced ledges to support a plurality of spaced parallel support rods 17 orthogonally oriented relative to the side walls 12 positioned interiorly of the framework 11 below an upper terminal edge thereof.

The support base 19 includes an exit opening 22 to receive the rectilinear framework 11 between the base side walls 20 against a floor 24. The floor 24 slopes downwardly between the support base side walls 20 extending from the support base rear wall 21 to a forward edge of the side walls, with a medially directed trough 23 arranged medially between floor side panels 26.

Figure 4:
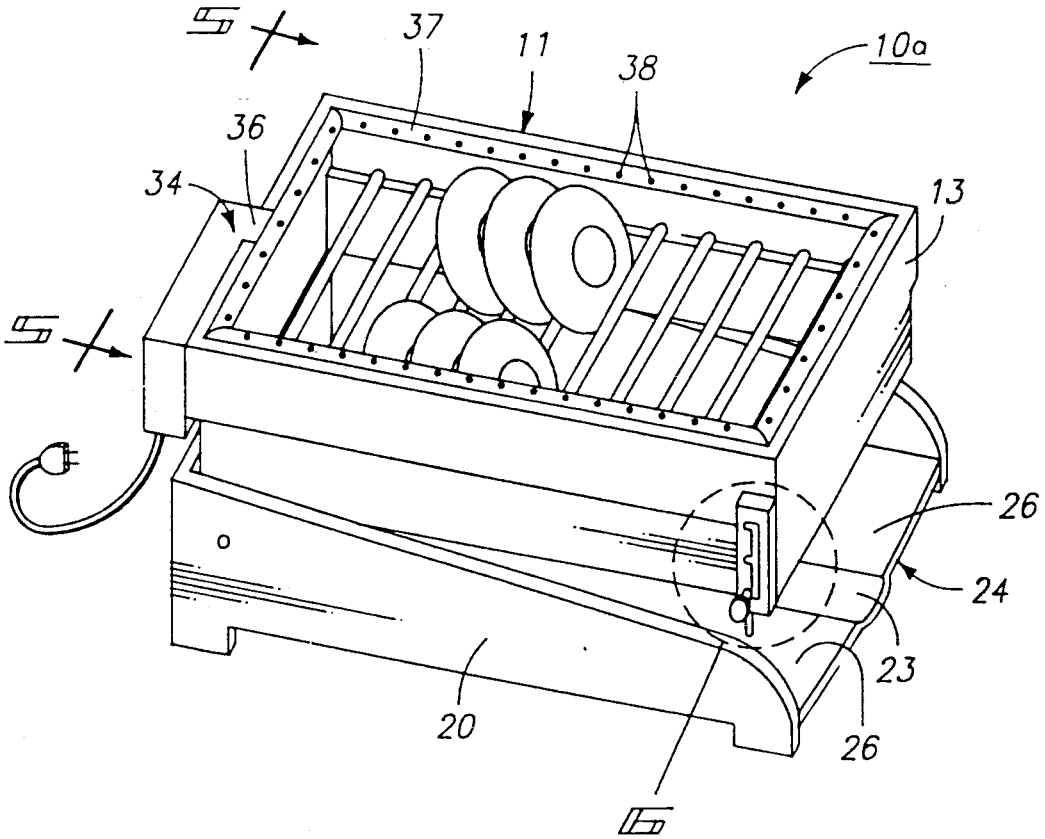
FIG. 4 is an isometric illustration of a modification of the invention.
Figure 5:
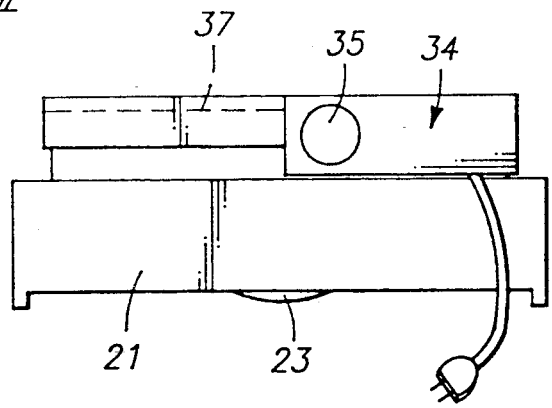
FIG. 5 is an orthographic view, taken along the lines 5—5 of FIG. 4 in the direction indicated by the arrows.
Figure 6:
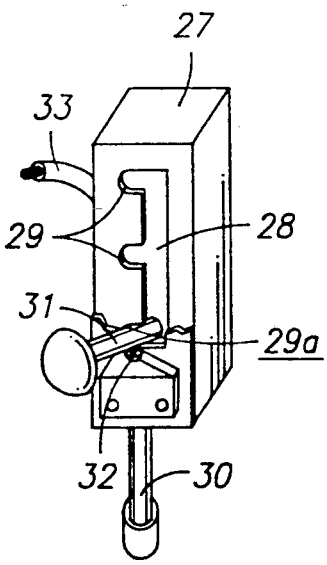
FIG. 6 is an isometric illustration of the adjustment member utilized by the apparatus, as illustrated in FIG. 4.
Figure 7:
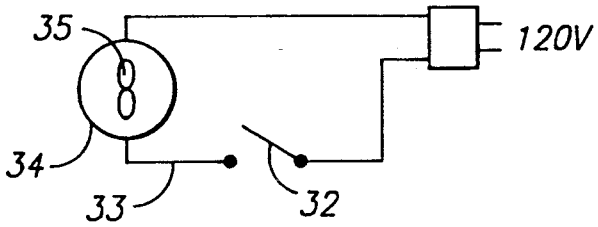
FIG. 7 is a diagrammatic illustration of a typical circuit utilized by the invention.

FIG. 4 illustrates a modified apparatus 10*a* that includes a modified adjustment member 15*a*, as illustrated in FIG. 6. The modified adjustment member 15*a* differs from the member 15 to include a switch member 32, to be described below. The adjustment member includes an adjustment housing 27 including a front wall, with a front wall slot 28 directed longitudinally and medially of the front wall, with the slot 28 vertically oriented to include a plurality of spaced paralled slot recesses 29 orthogonally intersecting the vertical slot 28. A projection leg 30 is slidably received through a bottom wall of the housing 27, to include a projection leg handle 31 fixedly and orthogonally mounted to an upper terminal end of the leg 30. The lowermost slot recess 29*a* includes the switch member 32 positioned adjacent thereto, whereupon projection of the handle 31 into the lowermost slot 29*a* effects actuation of the switch 32. Actuator switch 32 effects completion of a circuit directing current through a switch electrical line 33 into a blower motor 35 within a blower motor housing 34. Actuation of the blower motor 35 effects pneumatic delivery through a delivery conduit 36 into a continuous air manifold tube 37 positioned interiorly of the rectilinear framework 11 adjacent the upper terminal edge. The manifold tube 37 includes a series of spaced apertures 38 to direct drying air interiorly of the framework to assist in drying of dishes contained on the support rods 17.

Figure 8:
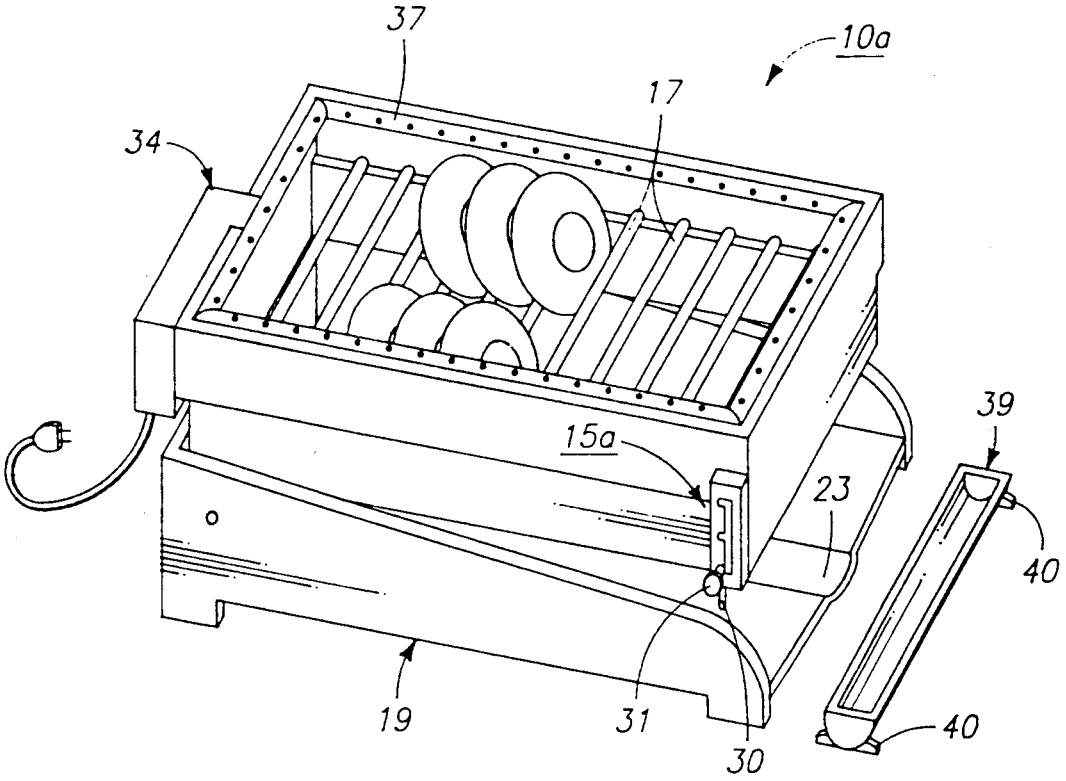
FIG. 8 is an isometric illustration of the invention utilizing a collection trough.
Figure 9:
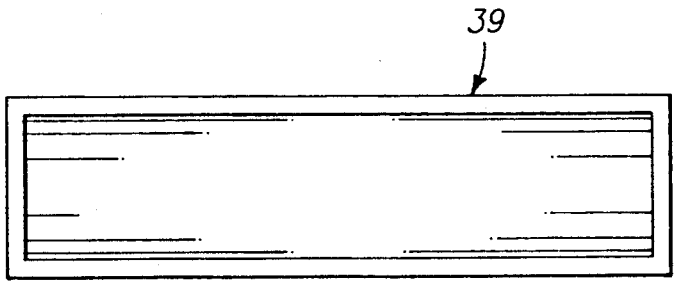
FIG. 9 is an orthographic top view of the collection trough.
Figure 10:
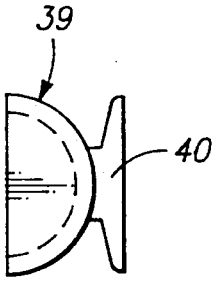
FIG. 10 is an orthographic end view of the collection trough.
Figure 11:
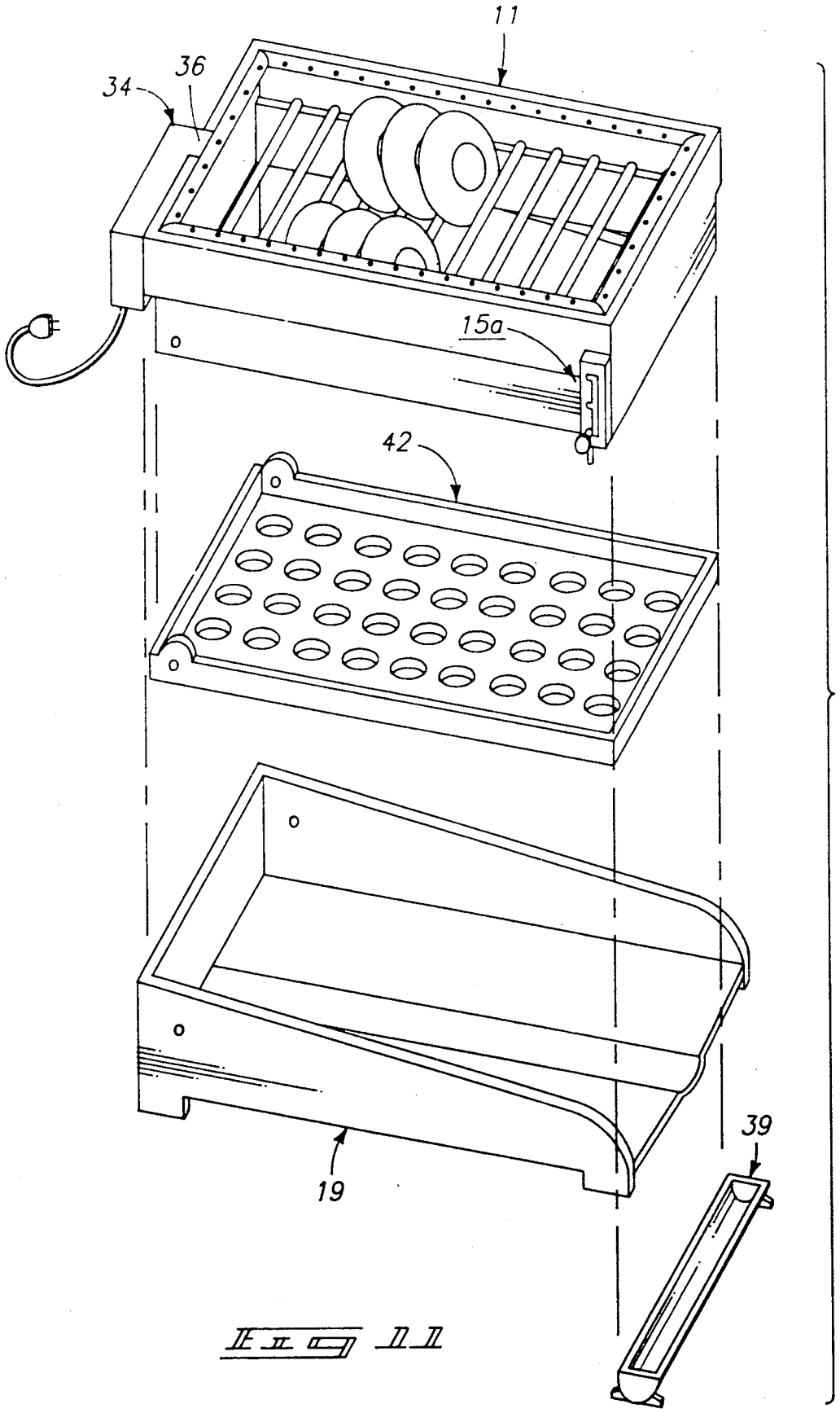
FIG. 11 is an isometric exploded illustration of the invention, as presented in FIG. 4.

As illustrated in FIG. 8, the organization further contemplates the use of a collection trough 39 formed of a semi-cylindrical configuration, including support legs 40 positioned to a bottom surface of the collection trough 39 at opposed terminal ends thereof to receive fluid when the collection is position in adjacency to the outer terminal edge of the trough 23.

It should be further noted that an apertured drainage plate 41 is fixedly mounted to a lower terminal edge of the rectilinear framework 11, to include a matrix of openings therethrough to direct fluid into the underlying support base 19.

Figure 12:
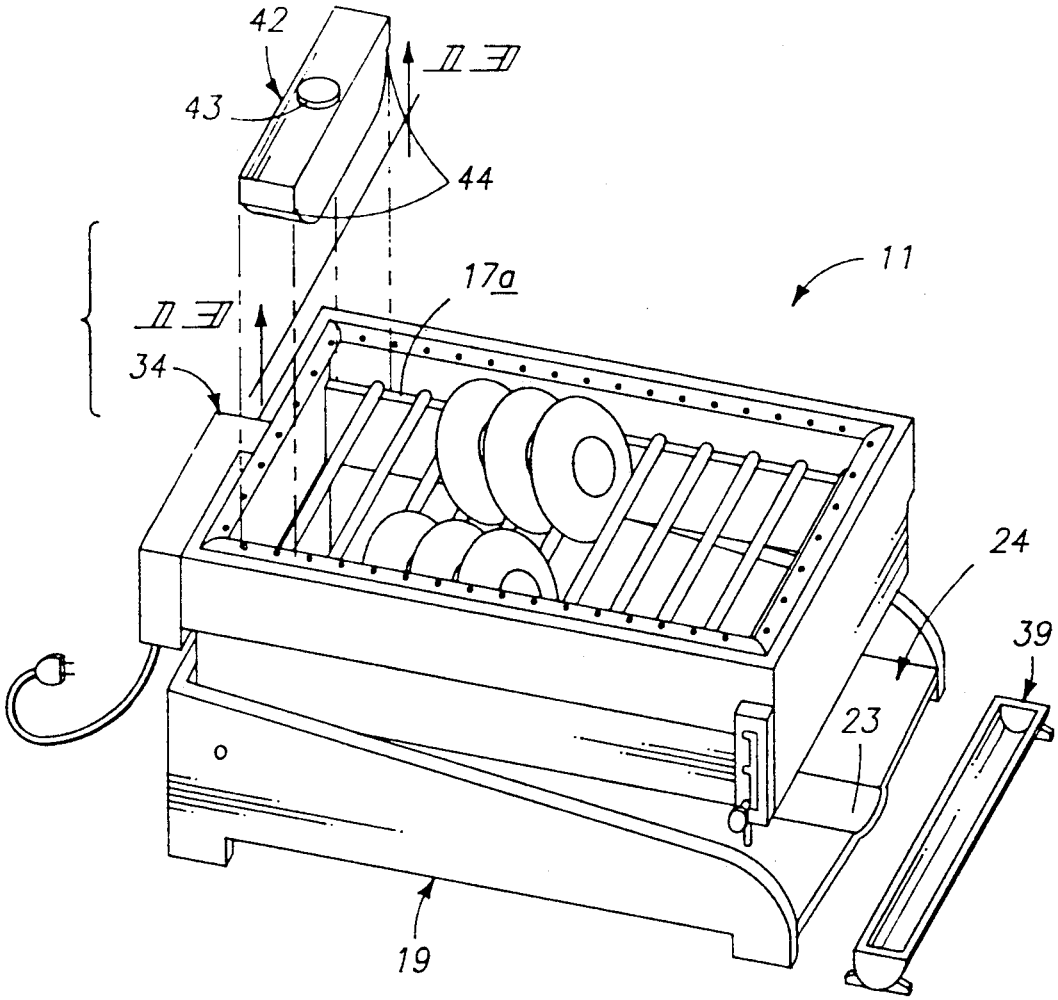
FIG. 12 is an isometric illustration of the invention utilizing a reservoir.
Figure 13:
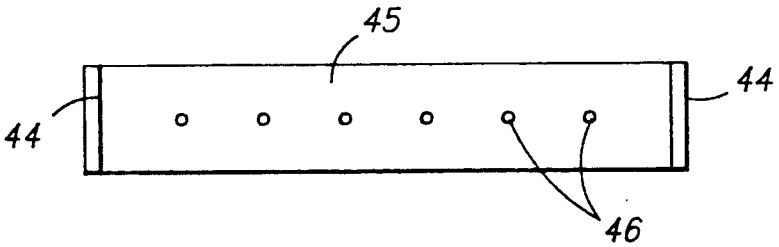
FIG. 13 is an orthographic bottom view of the reservoir as presented on the lines 13—13 of FIG. 12 in the direction indicated by the arrows.

Further, the modified apparatus as illustrated in FIG. 12, includes a fluid reservoir 42 for containing an anti-fungal and/or anti-bacterial fluid therewithin to direct such fluid to the floor 24 to rid the floor of accumulating bacteria and the like to minimize maintenance of the apparatus. The fluid reservoir includes a fill cap 43 directed through a top wall thereof, wherein bottom wall recesses 44 are spaced apart a predetermined spacing to equal a predetermined spacing defined between the support rod ledges 17*a* to thereby accommodate the reservoir between the ledges 17*a* adjacent the framework rear wall 14. The bottom wall 45 further includes a series of bottom wall apertures 46 to direct fluid from within the reservoir 42 therethrough onto the underlying floor 24.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A dish drainage apparatus, comprising, an upper rectilinear framework, including spaced parallel framework side walls, a framework front wall spaced from and parallel a framework rear wall, the upper rectilinear framework including an upper perimeter edge spaced from a lower perimeter edge, and at least one adjustment member mounted to at least one of said framework side wall adjacent the framework front wall, and a support base, the support base including spaced parallel support base side walls, a support base rear wall, and a support base exit opening directed between the side walls between a forward terminal end of each side wall, and a support base floor coextensively mounted to the support base extending from the support base rear wall and angulated downwardly relative to the support base side walls extending from the support base rear wall to the forward terminal end of the support base side walls, and the support base floor including a support base trough directed medially of the support base floor, wherein the support base trough extends from the rear wall to the exit opening, and the upper rectilinear framework pivotally mounted to the support base above the trough, and each framework side wall of the framework side walls includes a support rod ledge positioned below the framework upper perimeter edge, wherein each ledge of each side wall is arranged coextensively along each side wall in a parallel relationship relative to one another, and a plurality of support rods fixedly mounted orthogonally between the framework side walls fixedly secured to each ledge, and the framework side walls spaced apart a predetermined spacing, and a pivot axle directed through the support base side walls adjacent to and parallel the support base rear wall, with the pivot axle directed through the upper rectilinear framework relative to the support base, and the adjustment member includes an adjustment member housing, and the housing including a housing front wall, with the front wall including a front wall slot orthogonally oriented relative to the framework lower perimeter edge, wherein the front wall slot includes a plurality of spaced slot recesses, the slot recesses arranged parallel relative to one another and orthogonally oriented relative to the front wall slot, wherein a lowermost slot recess of the plurality of slot recesses is positioned in alignment with a lower terminal edge of the front wall slot, and a projection leg directed through the housing, with the projection leg including a handle fixedly mounted to an upper terminal end of the projection leg, the handle directed through the front wall slot and selectively receivable with one of said slot recess, and the housing includes a switch mounted within the housing adjacent the lowermost recess, and a blower motor housing mounted to the upper rectilinear framework, the blower motor housing including a blower motor contained therewithin, and a continuous air manifold tube positioned fixedly within the upper rectilinear framework adjacent the upper perimeter edge, with the continuous air manifold tube in pneumatic communication with the blower motor housing, and the air manifold tube including a matrix of spaced apertures directed through the air manifold tube projecting interiorly of the uppermost linear framework to direct drying air into the upper rectilinear framework, and an apertured drainage plate mounted to the framework lower perimeter edge, wherein the drainage plate includes a matrix of through-extending openings to direct fluid through the drainage plate onto the support base floor, and a collection trough positioned adjacent the exit opening and the trough directed through the support base floor to receive fluid from the support base trough, and further including a fluid reservoir removably mounted within the upper rectilinear framework between the framework side walls, wherein the fluid reservoir includes a reservoir bottom wall, the bottom wall includes a plurality of bottom wall recesses, wherein the bottom wall recesses are spaced apart the predetermined spacing for mounting upon the spaced ledges, and the bottom wall further including a series of apertures directed therethrough between the bottom wall recesses for directing an anti-fungal and/or anti-bacterial fluid onto the support base floor.

* * * * *